US012458085B2

(12) United States Patent
Johnson

(10) Patent No.: US 12,458,085 B2
(45) Date of Patent: Nov. 4, 2025

(54) GROW WEAR

(71) Applicant: Kids Growwear, LLC, Orlando, FL (US)

(72) Inventor: Paulette Johnson, Orlando, FL (US)

(73) Assignee: Kids Growwear, LLC, Orlando, FL (US)

( * ) Notice: Subject to any disclaimer, the term of this patent is extended or adjusted under 35 U.S.C. 154(b) by 0 days.

(21) Appl. No.: 17/326,239

(22) Filed: May 20, 2021

(65) Prior Publication Data

US 2021/0392976 A1 Dec. 23, 2021

Related U.S. Application Data

(60) Provisional application No. 63/040,987, filed on Jun. 18, 2020.

(51) Int. Cl.
*A41D 15/00* (2006.01)
*A41D 11/00* (2006.01)

(52) U.S. Cl.
CPC ..... *A41D 15/002* (2013.01); *A41D 11/00* (2013.01); *A41D 2300/324* (2013.01)

(58) Field of Classification Search
CPC ..... A41D 15/002; A41D 11/00; A41D 2300/324; A41D 15/00
USPC ..... 2/269
See application file for complete search history.

(56) References Cited

U.S. PATENT DOCUMENTS 1,012,897 A * 12/1911 Nathan et al. ..... A41D 1/06 2/232
2,153,068 A * 4/1939 Arden ..... A41F 19/005 2/325
2,602,163 A * 7/1952 Davenport ..... A41D 15/002 2/75
2,724,120 A * 11/1955 Biern ..... A41D 15/002 2/269
3,170,167 A * 2/1965 Isaacs ..... A41D 27/145 2/232
4,149,275 A * 4/1979 Sanchez ..... A41D 1/06 2/269
4,200,938 A * 5/1980 LeTourneau ..... A41D 15/002 2/269

(Continued)

FOREIGN PATENT DOCUMENTS

DE 19715134 A1 * 10/1998 ..... A41D 13/04

OTHER PUBLICATIONS

Translation of DE19715134, Heilgeist, Hans-Joachim, Oct. 15, 1998 (Year: 1998).*

*Primary Examiner* — Heather Mangine

(57) ABSTRACT

A garment configured with an adjustment mechanism to add or subtract measurements at its hem is implemented to provide a parent or wearer more control over their garment's size. The size can be permanently adjustable so that the wearer can change the length of the garment daily. Exemplary garments can include pants, jeans, leggings, shorts, shirts, dresses, skirts, pajamas, coats, jackets, etc. The garment is configured with an upper connection segment, middle connection segment, and lower connection segment positioned on the garment's interior (i.e., the inside-out section). In typical implementations, the connection segments are arranged near an end portion of a garment, such as at or near the bottom of a pair of pants, the sleeves of a shirt, the bottom of a skirt, etc.

5 Claims, 9 Drawing Sheets

(56) References Cited

U.S. PATENT DOCUMENTS 4,215,435 A * 8/1980 Miele ..... A41D 15/002 2/269
4,543,670 A * 10/1985 Ehring ..... A41D 27/10 2/124
4,573,218 A * 3/1986 Saggs ..... A41D 15/002 2/93
5,033,127 A * 7/1991 Schmeltz ..... A41D 27/00 2/125
5,539,932 A * 7/1996 Howard ..... A41D 1/06 2/269
5,708,977 A * 1/1998 Morkunas ..... A41D 15/002 2/269
6,058,508 A * 5/2000 Brown Honeysuckle ..... A41B 13/005 2/69
6,223,352 B1 * 5/2001 Watlington ..... A41D 15/002 2/83
6,408,438 B1 * 6/2002 Mc Kee ..... A41D 15/002 2/244
7,966,669 B1 * 6/2011 Siepmann ..... A41D 15/002 2/123
2004/0209018 A1 * 10/2004 Lookholder ..... A61G 1/01 428/33
2007/0169250 A1 * 7/2007 Maniguet ..... A41D 13/0575 2/227
2007/0266472 A1 * 11/2007 DuFaux ..... A41D 15/002 2/80
2008/0127398 A1 * 6/2008 Ryan ..... A41D 27/245 2/243.1
2009/0205112 A1 * 8/2009 Solowey ..... A41D 15/002 2/269
2010/0281601 A1 * 11/2010 Clarke ..... A41D 1/08 2/269
2014/0173813 A1 * 6/2014 Mazzarolo ..... A41D 15/002 2/24
2014/0196188 A1 * 7/2014 Brady ..... A41D 15/00 2/67
2017/0006941 A1 * 1/2017 Meyer ..... A41D 15/002
2018/0168251 A1 * 6/2018 Loveland ..... A41D 1/14
2018/0235290 A1 * 8/2018 Pfanner ..... A44B 19/24
2018/0242661 A1 * 8/2018 Giese ..... A41D 1/08
2018/0255853 A1 * 9/2018 Spathas ..... B65D 33/00
2020/0170316 A1 * 6/2020 Barski ..... A41D 1/06
2021/0392976 A1 * 12/2021 Johnson ..... A41D 11/00

* cited by examiner

GROW WEAR

CROSS-REFERENCE TO RELATED APPLICATIONS

This non-provisional utility patent application claims the benefit of and priority to U.S. Provisional Patent Application Ser. No. 63/040,987, filed Jun. 18, 2020, entitled "Systems and Methods for the Length Adjustment of Garments," the entire contents of which are hereby incorporated herein by reference.

BACKGROUND

Children's clothing tends to become obsolete after several months due to the child's rapid and constant growth. A child's growth makes it difficult for a parent to keep pace with adequate clothing given the permanency of a clothing's size and measurements. Furthermore, adults can be frustrated that, for example, their business-casual skirt cannot lose a few inches for when they go out on a Saturday night.

SUMMARY

A garment configured with an adjustment mechanism to add or subtract measurements at the hem of the garment is implemented to provide the parent or wearer more control over their garment's size. The size can be permanently adjustable so that the wearer can change the length of the garment daily. Exemplary garments can include pants, jeans, leggings, shorts, shirts, dresses, skirts, pajamas, upper coats, jackets, etc.

The garment is configured with an upper connection segment, middle connection segment, and lower connection segment positioned on the garment's interior (i.e., the inside-out section). These connection segments herein may be referred to as male or female segment snaps, but other forms of connection mechanisms are also possible. In typical implementations, the connection segments are arranged near an end portion of a garment, such as at or near the bottom of a pair of pants, the sleeves of a shirt, the bottom of a skirt, etc.

The upper and lower connection segments may be female snaps, and the middle connection segment may be male snaps. The upper and lower connection segments can separately connect to the middle connection segment, but the upper and lower connection segments, in typical implementations, may not connect to each other. For example, the upper and lower connection segments may be female snaps that can connect to the middle connection segment's male snaps.

By connecting, for example, the middle connection segment to the upper connection segment, the hem of the pants is forced upward and thereby removes length from the bottom of the pants' hem. In contrast, when the upper connection segment is not connected to the middle-connected segment, the hem of the pants can be adjusted downward, adding length to the pants' hem. Therefore, using the upper and middle connection segments provides at least two different measurements for the pants. This length adjustment can extend the shelf life of the pants for the wearer during growth or enable an adult to adjust their outfit based on their present situation or culture. The lower connection segment is designed to cover the middle connection segment (male snaps) so that the male snaps don't irritate the user or scratch their skin.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
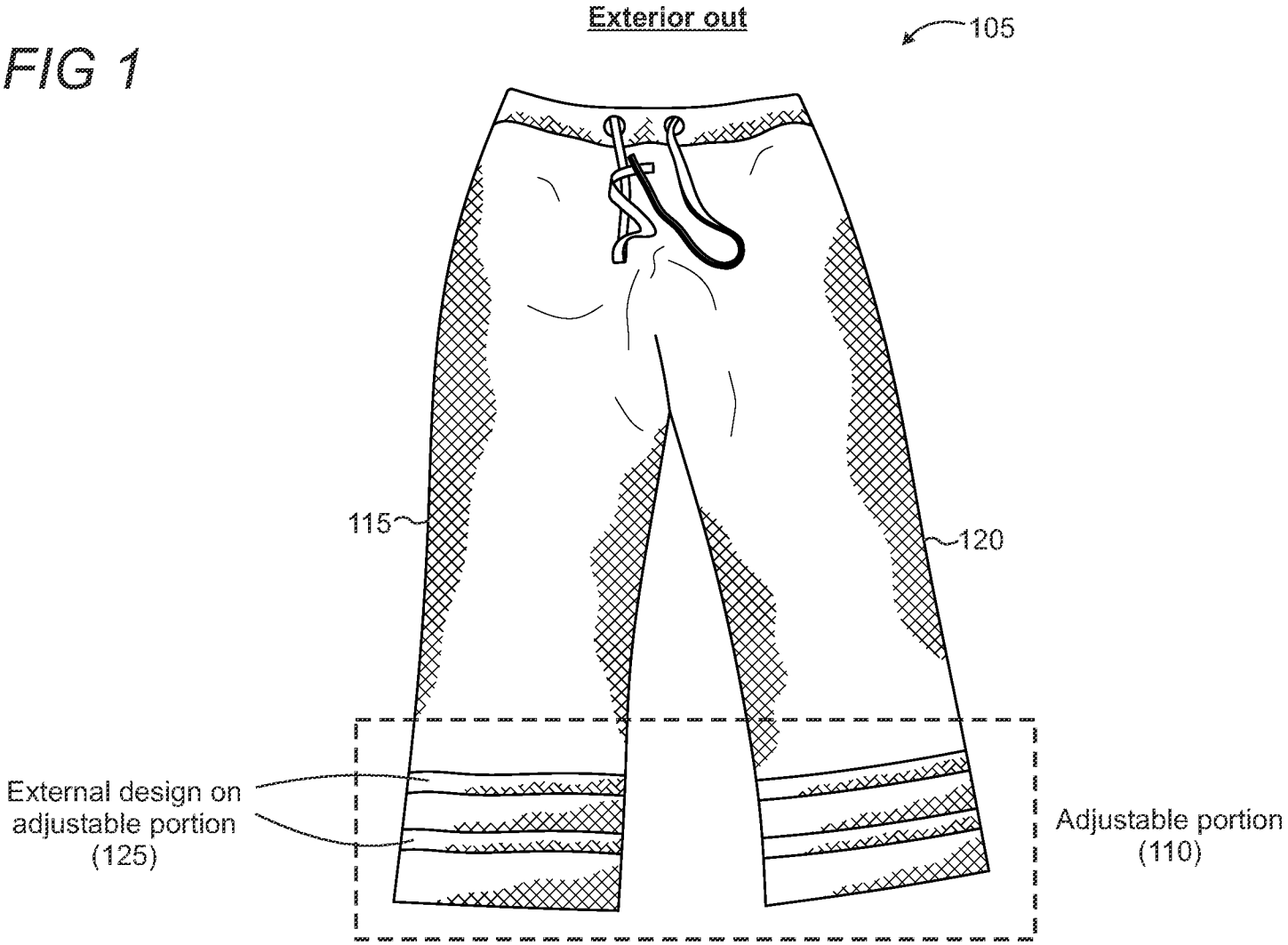
FIG. 1 shows an illustrative representation of a pant garment's exterior.

FIG. 1 shows an illustrative representation in which a pair of pants 105 are exterior out, and the bottom of the pants has an adjustable portion 110. The pants have a right leg 115 and left leg 120, and the adjustable portion is arranged on each pant legs' hem. The adjustment mechanism is positioned on the pants' interior, but the pants have an external design 125 on the adjustable portion 110 of the pants. In this example, a pair of stripes extend laterally across the exterior lower portion of each pant leg to conceal the stitching from the lengthening mechanism sewn on the inside of the garment. The stripes may have a tint or color different from the rest of the pants. Alternatively, the external design 125 on the adjustable portion 110 may have various designs that are not stripes but nevertheless designed to conceal the adjustment mechanism on the interior lower portion of the pants.

Figure 2:
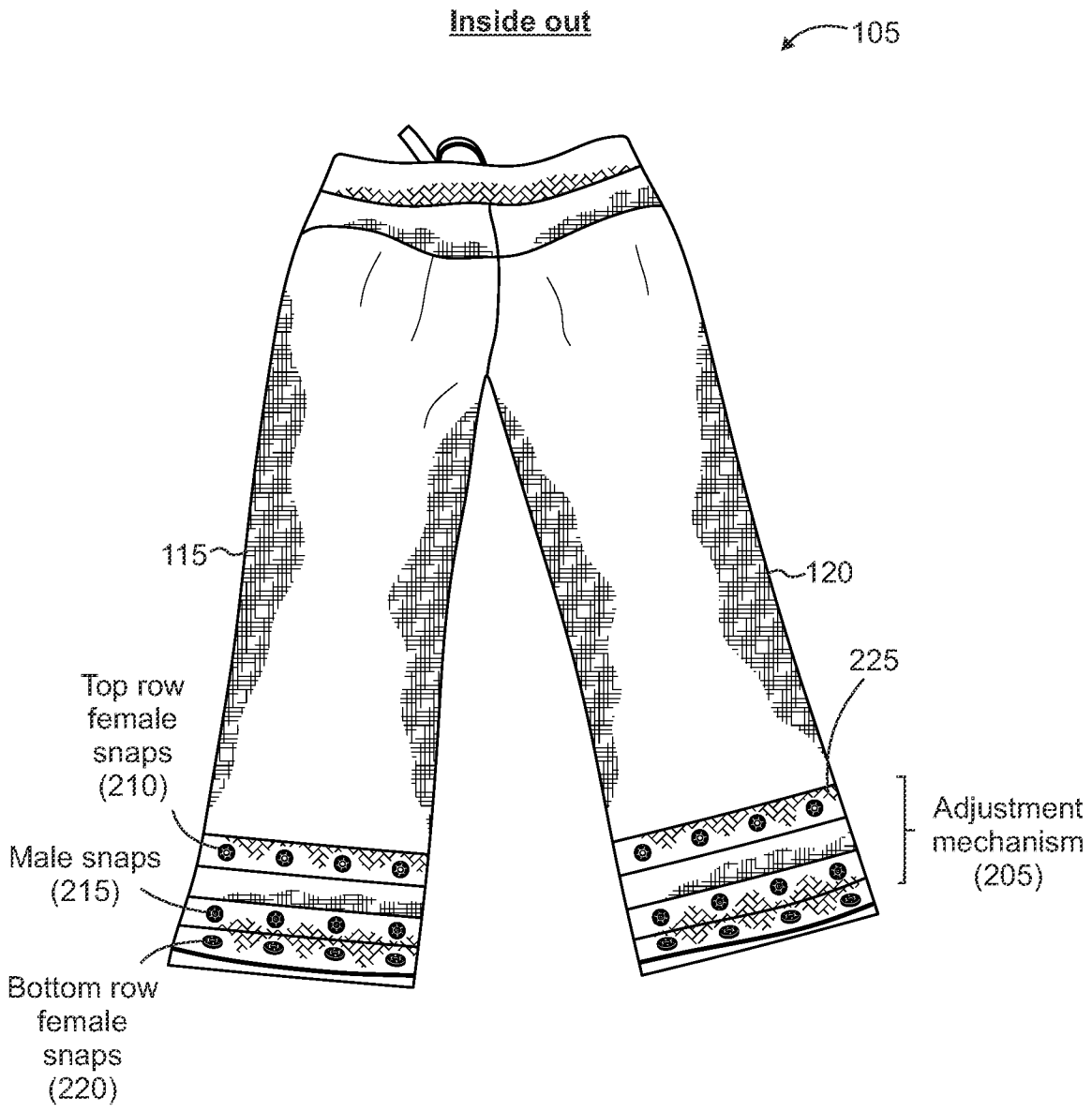
FIG. 2 shows an illustrative representation of the pant's interior.

FIG. 2 shows an illustrative representation in which the pants 105 are inside out such that the interior of the pants is shown. The adjustable portion 110 (FIG. 1) includes an adjustment mechanism 205 arranged at the bottom portion of each pant leg. In this implementation, the adjustment mechanism is a series of male and female snaps that can connect to adjust the length of the pants.

The pants 105 include an upper segment female snaps 210, middle segment male snaps 215, and a bottom row female snaps 220. Since the upper segment and bottom row are the same connection type of female snaps, they are incapable of fastening to each other. These snaps may be arranged similarly on each pant leg. In this implementation, the segments represent rows for a set of snaps. Each segment may be on an additional layer of cloth 225 stitched to the pants' interior material (e.g., cotton, jeans, polyester, etc.) and to which the snaps are attached. The additional layer 225 may be the same or different from the pants' material and can be, for example, cotton, jeans, polyester, etc. The snaps may be connected to the additional layer via, for example, stitching, adhesive, or a combination thereof.

Figure 3:
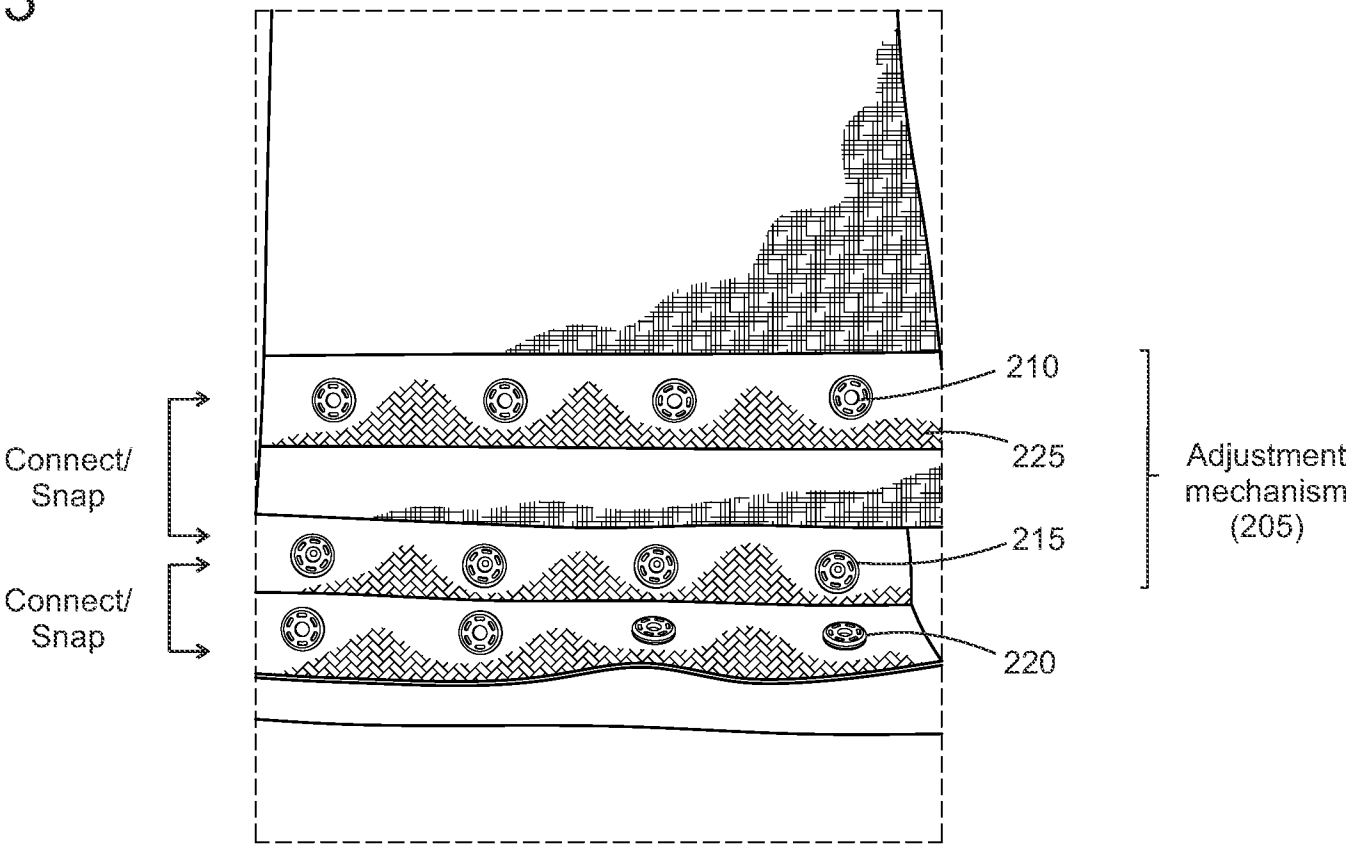
FIG. 3 shows an illustrative representation of an adjustment mechanism on the pant's interior.
Figure 4:
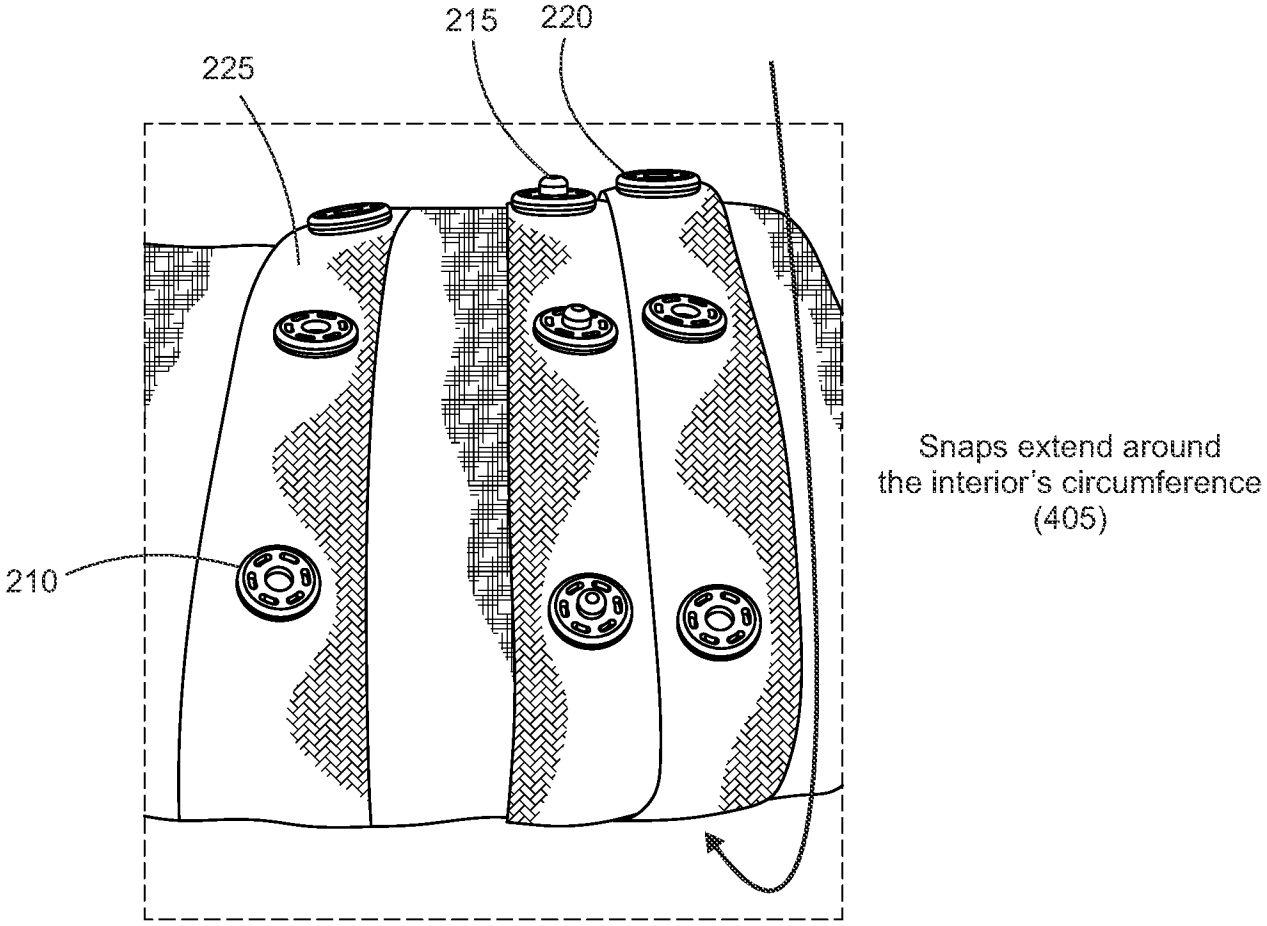
FIG. 4 shows an illustrative representation of the pant's adjustment mechanism extending around the interior's entire circumference.

FIG. 3 shows an illustrative close-up representation of the adjustment mechanism 205. The middle segment male snaps 215 can connect to the upper segment female snaps 210, which forces the hem upward and thereby shortens the pants' length. The upper and lower connection segments may not be connectable in scenarios in which, as shown in the drawings, they are the same connection mechanism, such as both being female snaps. FIG. 4 shows an illustrative close-up representation of the adjustment mechanism, in which each segment's snaps extend around the interior circumference 405 of the pants. The placement of the snaps provides additional support to the entire pants' hem when connected so that the pants do not come undone and hang below the intended bottom of the hem.

Figure 5:
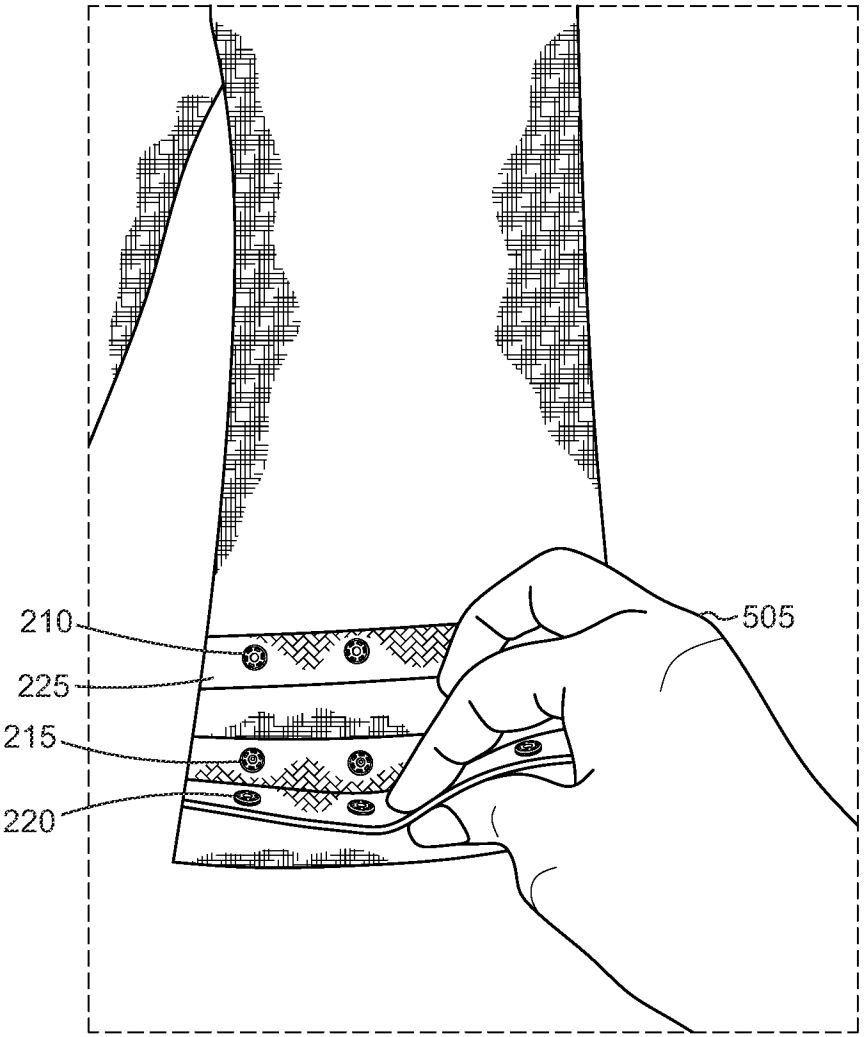
FIG. 5 shows an illustrative representation in which a user engages the middle connection segment male snap and the lower connection segment female snaps.
Figure 6:
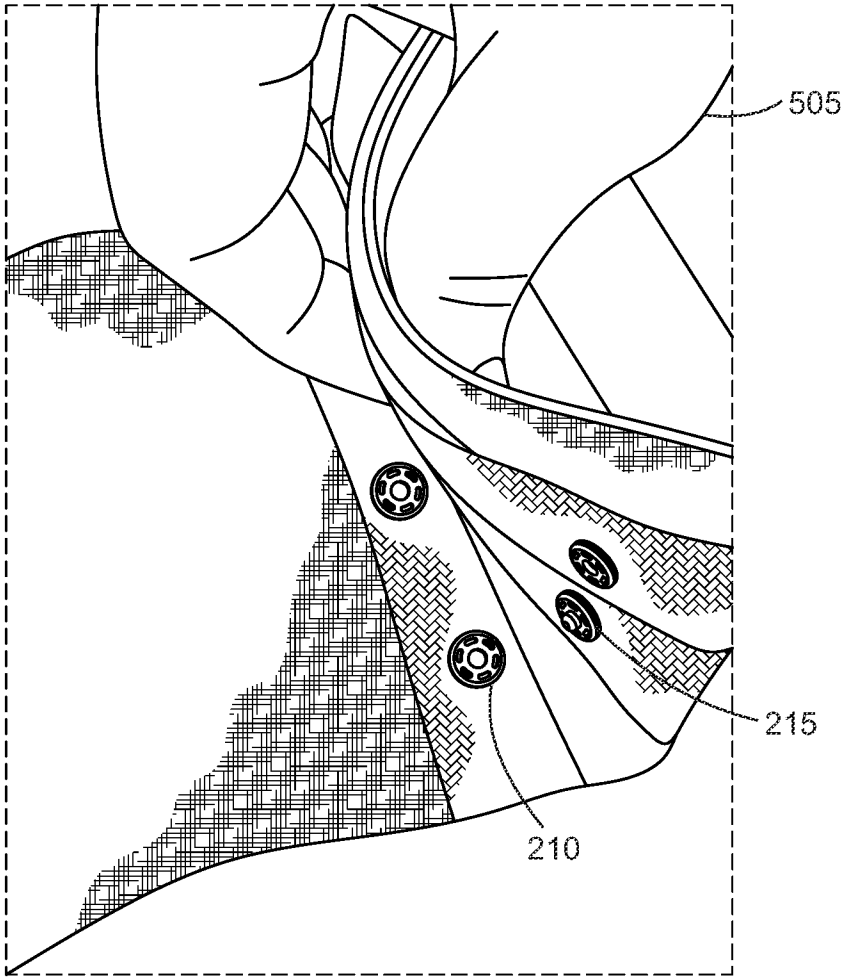
FIG. 6 show an illustrative representation in which a user engages the upper connection segment female snaps and middle connection segment male snaps on the adjustment mechanism to remove length from the garment.

FIGS. 5 and 6 show illustrative representations in which a user 505 attempts to connect the middle connection segment male snaps 215 to the bottom connection segment female snaps 220 to prevent the scratching of the user's skin. FIG. 6 shows the user connect the middle segment male snaps 215 to the upper segment female snaps 210. By doing so, the user effectively reduces the length of the pants.

Figure 7:
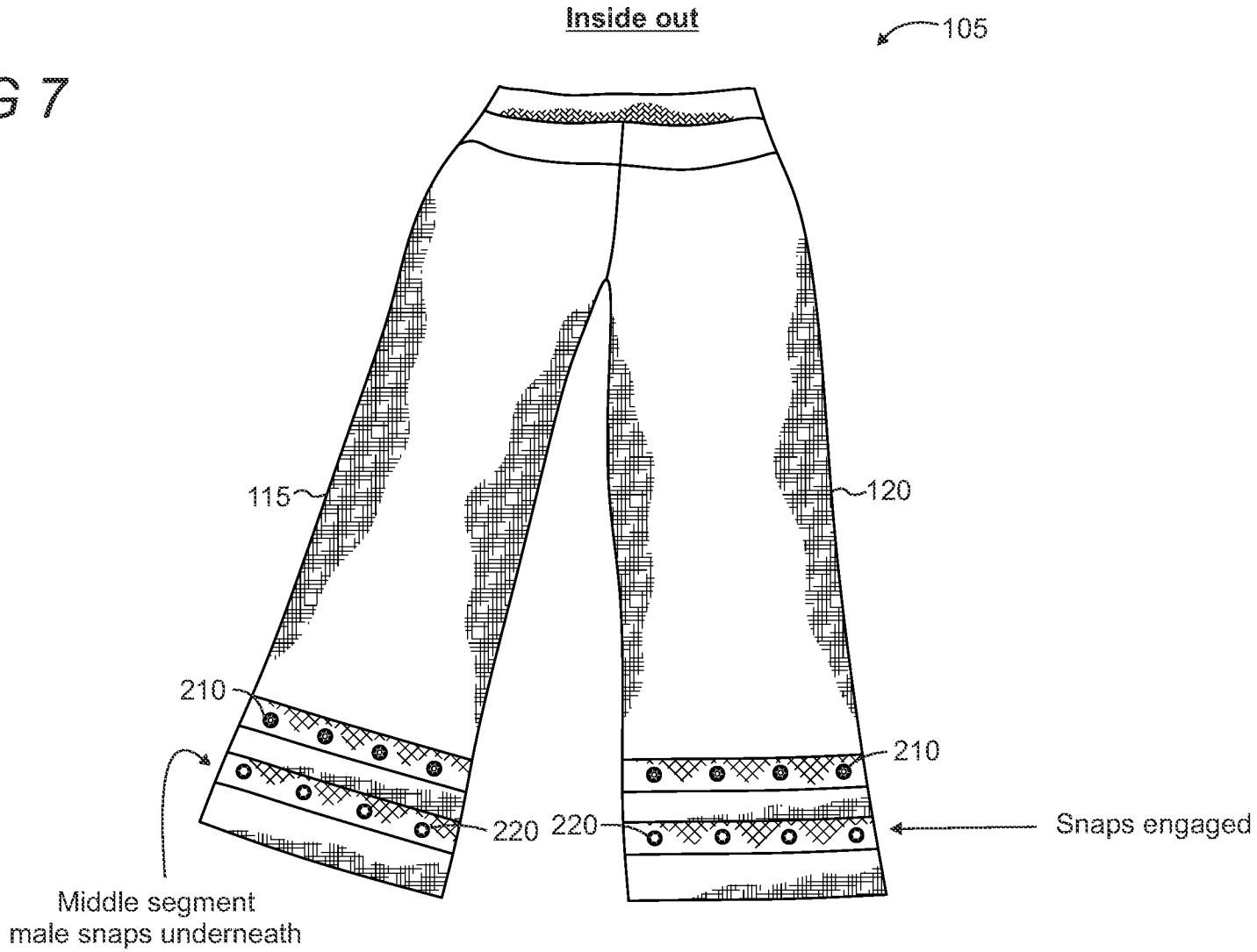
FIG. 7 shows an illustrative representation of the pants inside out with the snaps middle connection segment male snaps and lower connection segment female snaps connected.

FIG. 7 shows an illustrative representation in which the pants have been lengthened, in that the upper connection segment female snaps 210 and the middle connection segment male snaps 215 are not engaged on the right leg 115 and left leg 120. The bottom segment female snaps 220 are connected to the middle segment male snaps 215, which are not shown as they are underneath the female snaps 220, to prevent scratching but otherwise has no affect on the pant's length. The wearer can lengthen the size in the future when, for example, a child outgrows the current length. For other types of clothing, like a dress, a lady can shorten or lengthen the skirt based on the event (e.g., professional or recreational). In typical implementations, the wearer may shorten or lengthen pants by connecting or disconnecting the middle connection segment male snaps 215 to the upper connection segment snaps 210.

Figure 8:
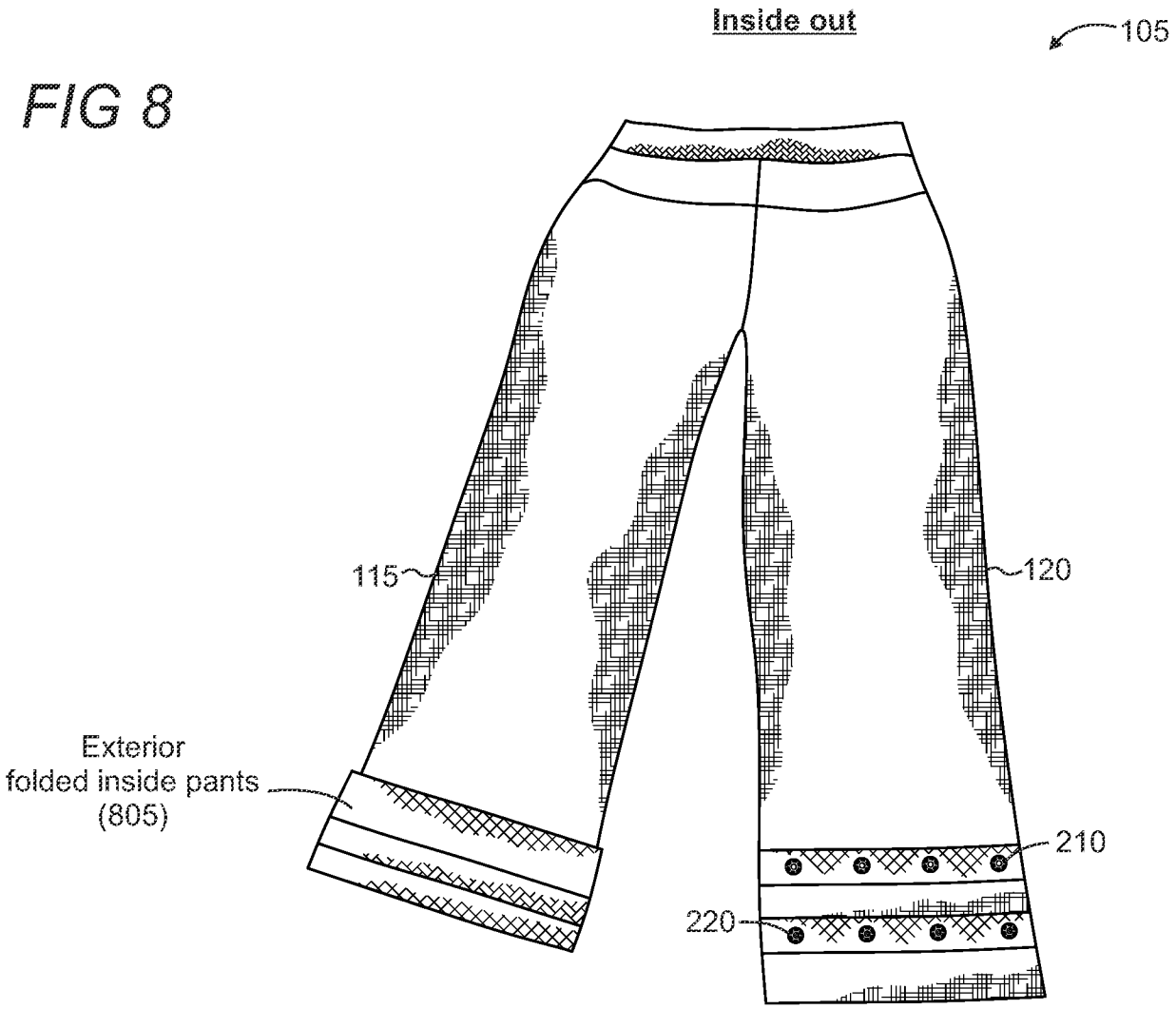
FIG. 8 shows an illustrative representation of the pants inside out with the bottom section folded over on one side.

FIG. 8 shows an illustrative representation in which the upper connection segment female snaps 210 and the middle connection segment male snaps 215 are engaged on the right leg 115. The pants' exterior is folded inside the pants, as representatively shown by numeral 805. The exterior folds inside the pants when snaps 210 and 215 are engaged, thereby hiding the extra length. The left pant leg 120, which is unfolded in FIG. 8 for comparison purposes, shows when the middle connection segment male snaps 215 and the bottom connection segment female snaps 220 are engaged to prevent scratches.

Figure 9:
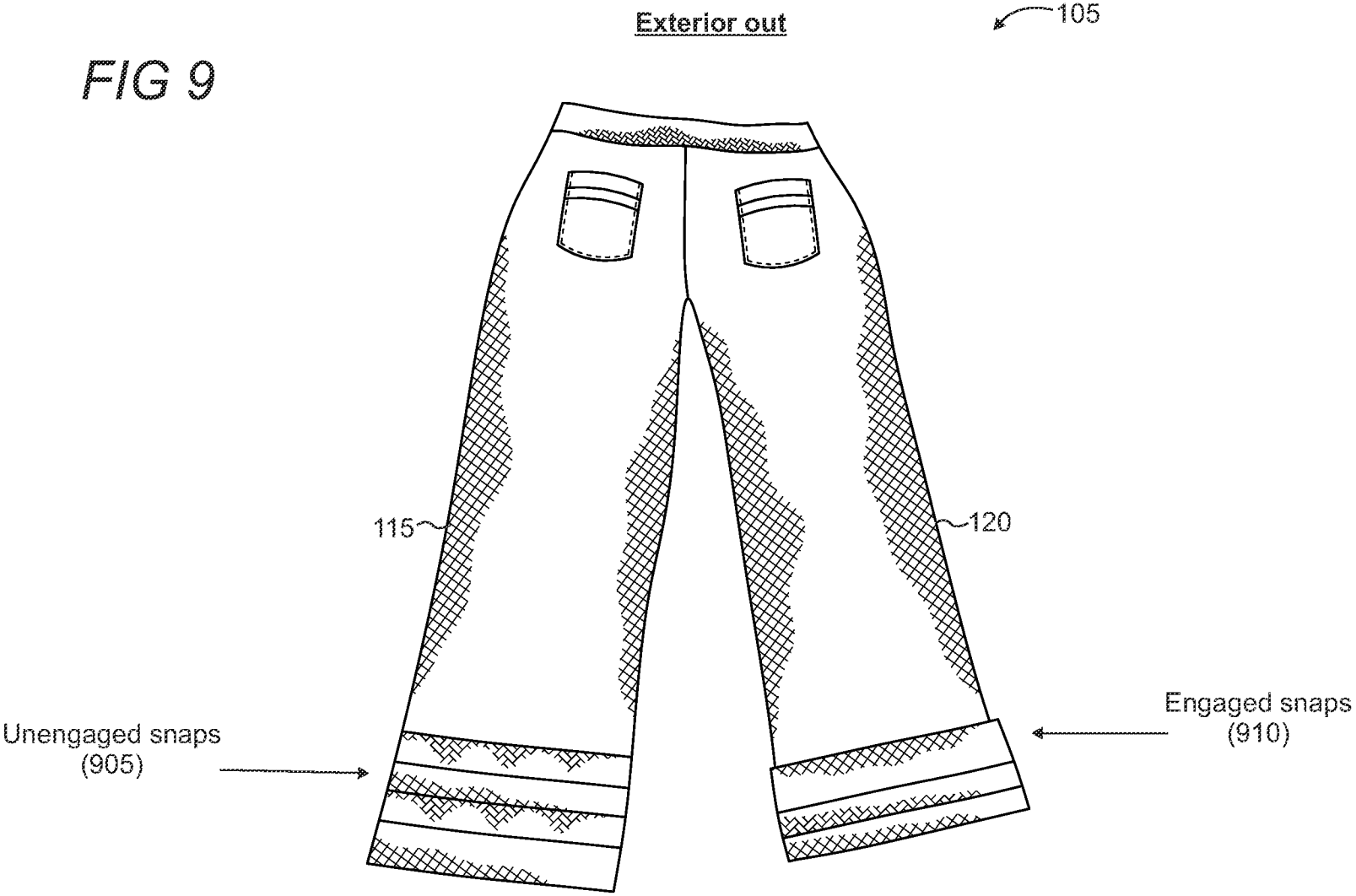
FIG. 9 shows an illustrative representation of the pants' exterior out with the snaps connected on one side.

FIG. 9 shows an illustrative representation of the garment's exterior in which the upper connection segment female snaps and the middle connection segment male snaps on the left pant leg 120 are engaged, and the snaps on the right pant leg 115 are unengaged. The left pant leg 120 shows the shorter length available when the upper segment female snaps 210 are engaged with the middle segment male snaps 215, as representatively shown by numeral 910. The pants can be extended in length when the upper connection segment female snaps and the middle connection segment male snaps are unengaged, as representatively shown by numeral 905.

The adjustment mechanism can apply to other pieces of clothing as well, like a skirt. For example, an inside-out skirt has an upper segment of female snaps, a middle segment of male snaps, and a bottom segment of female snaps. The upper segment of female snaps can engage with the middle segment of male snaps to adjust the length of the skirt. The connection may perform similarly as discussed above with respect to the pants.

Other implementations of the adjustment mechanism for clothing are also possible. For example, a piece of clothing may have any number of connection segments instead of the three shown in the pants. The clothing may have multiple tiers of connection segments to enable a wearer to change the garment's length three, four, or more times throughout the garment's life cycle.

Other types and styles of clothing may also utilize the adjustment mechanism, such as leggings, jeans, shirts (e.g., the sleeves or the bottom hem), coats, jackets, dresses, etc. Connection and adjustment mechanisms other than snaps may also be utilized, such as hook and loop fasteners (e.g., Velcro®), magnets, buttons, etc. These other connection mechanisms may operate similar to the snaps described above, such as having one connection member (e.g., the hook portion) and a second connection member (e.g., the loop portion) vertically above or below each other. The two connection members can then be connected, which translates to adjusting the pants' measurement.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A garment, comprising:

a body comprising:

an exterior side;

an interior side; and an adjustment mechanism to lengthen and shorten the garment, the adjustment mechanism comprising only three segments, including:

an upper connection segment;

a middle connection segment positioned below the upper connection segment; and a lower connection segment positioned below the middle connection segment, such that the middle connection segment is positioned between the upper and lower connection segments, between meaning that the middle connection segment separates a region of the lower connection segment from a region of the upper connection segment, wherein the upper, middle, and lower connection segments' positioning is while the adjustment mechanism is fully unengaged and the garment is fully unfolded, such that the middle connection segment is fully unengaged with the upper connection segment, and the middle connection segment is fully unengaged with the lower connection segment, wherein the lower connection segment is a separate and distinct flap that is connected to the body of the garment and is entirely above a lower terminal edge of the body of the garment when the adjustment mechanism is fully engaged and when fully unengaged, wherein, when the lower connection segment is unconnected with the middle connection segment, the flap is laterally adjacent to and thereby overlaps with the body of the garment wherein the middle connection segment is adapted to connect to the upper and lower connection segments, and the upper and lower connection segments each comprises male connectors or each comprises female receptacles.

2. The garment of claim 1, wherein the upper and lower connection segments comprises the female receptacles, and the middle connection segment comprises the male connectors.

3. The garment of claim 2, wherein the upper and middle connection segments are each affixed to an additional layer on top of the body of garment.

4. The garment of claim 3, wherein the upper, middle, and lower connection segments extend around a lower circumference of the garment.

5. The garment of claim 4, wherein the upper, middle, and lower connection segments are positioned on the interior side of the body of garment.

* * * * *